US010267564B2

(12) United States Patent
Kim et al.

(10) Patent No.: US 10,267,564 B2
(45) Date of Patent: Apr. 23, 2019

(54) HEAT TREATMENT CONTAINER FOR VACUUM HEAT TREATMENT APPARATUS

(75) Inventors: Byung Sook Kim, Seoul (KR); Min Sung Kim, Seoul (KR); Kyoung Hoon Chai, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 868 days.

(21) Appl. No.: 13/813,270

(22) PCT Filed: Feb. 1, 2011

(86) PCT No.: PCT/KR2011/000682

§ 371 (c)(1),
(2), (4) Date: Apr. 9, 2013

(87) PCT Pub. No.: WO2012/015132

PCT Pub. Date: Feb. 2, 2012

(65) Prior Publication Data

US 2013/0196278 A1 Aug. 1, 2013

(30) Foreign Application Priority Data

Jul. 30, 2010 (KR) ..... 10-2010-0074423
Nov. 3, 2010 (KR) ..... 10-2010-0108913

(51) Int. Cl.

| | |
|---|---|
| ***F27B 14/04*** | (2006.01) |
| ***F27B 5/04*** | (2006.01) |
| ***F27B 5/06*** | (2006.01) |
| ***F27D 5/00*** | (2006.01) |
| ***F27B 14/10*** | (2006.01) |

(52) U.S. Cl.
CPC ..... *F27B 14/04* (2013.01); *F27B 5/04* (2013.01); *F27B 5/06* (2013.01); *F27B 14/10* (2013.01); *F27D 5/0068* (2013.01)

(58) Field of Classification Search
None
See application file for complete search history.

(56) References Cited

U.S. PATENT DOCUMENTS 2,826,624 A * 3/1958 Reese ..... H05B 6/28 373/151
4,268,483 A * 5/1981 Davey ..... C30B 15/00 117/209

(Continued)

FOREIGN PATENT DOCUMENTS

EP 1076117 A2 2/2001
JP S59-172738 U 11/1984

(Continued)

OTHER PUBLICATIONS

International Search Report in International Application No. PCT/KR2011/000682, filed Feb. 1, 2011.

(Continued)

*Primary Examiner* — Steven B McAllister
*Assistant Examiner* — John Bargero
(74) *Attorney, Agent, or Firm* — Saliwanchik, Lloyd & Eisenschenk

(57) ABSTRACT

A heat treatment container for a vacuum heat treatment apparatus according to an exemplary embodiment includes a bottom portion and a sidewall, and a support protruding inward.

1 Claim, 5 Drawing Sheets

(56) References Cited

U.S. PATENT DOCUMENTS

| | | | | |
|---|---|---|---|---|
| 4,354,831 | A * | 10/1982 | Shinkawa | F27B 14/10 266/275 |
| H000520 | H * | 9/1988 | Johnson | C30B 35/002 117/20 |
| 5,997,802 | A | 12/1999 | Holcombe, Jr. et al. | |
| 6,113,692 | A * | 9/2000 | Jaussaud | C30B 23/00 117/105 |
| 7,717,286 | B2 * | 5/2010 | Delcroix | B23K 23/00 220/366.1 |
| 2009/0038538 | A1 * | 2/2009 | Kaneko | C30B 19/04 117/54 |
| 2009/0155158 | A1 * | 6/2009 | Ito | C01B 33/037 423/349 |
| 2010/0012035 | A1 * | 1/2010 | Nagata | H01F 41/0293 118/725 |
| 2013/0095442 | A1 | 4/2013 | Kim et al. | |

FOREIGN PATENT DOCUMENTS

| | | | |
|---|---|---|---|
| JP | 60-149714 | A | 8/1985 |
| JP | 62-36398 | U | 3/1987 |
| JP | 62-284029 | | 12/1987 |
| JP | 63-096204 | | 4/1988 |
| JP | 02-176389 | | 7/1990 |
| JP | 03-177788 | | 8/1991 |
| JP | 04-302991 | | 10/1992 |
| JP | 05-302164 | A | 11/1993 |
| JP | 06-281090 | A | 10/1994 |
| JP | 07-026693 | A | 1/1995 |
| JP | 07-071690 | A | 3/1995 |
| JP | 08-188472 | | 7/1996 |
| JP | 08-313161 | A | 11/1996 |
| JP | 2002-107063 | A | 4/2002 |
| JP | 2003-240121 | A | 8/2003 |
| JP | 2005-035825 | A | 2/2005 |
| JP | 2007-240027 | A | 9/2007 |
| JP | 2009-256153 | A | 5/2009 |
| JP | 2013-515943 | A | 5/2013 |
| KR | 10-2006-0098497 | A | 9/2006 |
| KR | 10-2007-0028610 | A | 3/2007 |
| KR | 10-2007-0066232 | A | 6/2007 |
| KR | 10-2009-0056923 | A | 6/2009 |

OTHER PUBLICATIONS

Notice of Allowance dated Nov. 2, 2012 in Korean Application No. 10-2010-0074423, filed Jul. 30, 2010.

Office Action dated Dec. 27, 2012 in Korean Application No. 10-2010-0108913, filed Nov. 3, 2010.

Office Action dated Nov. 14, 2014 in Japanese Application No. 2013-523075.

* cited by examiner

[Fig. 1]
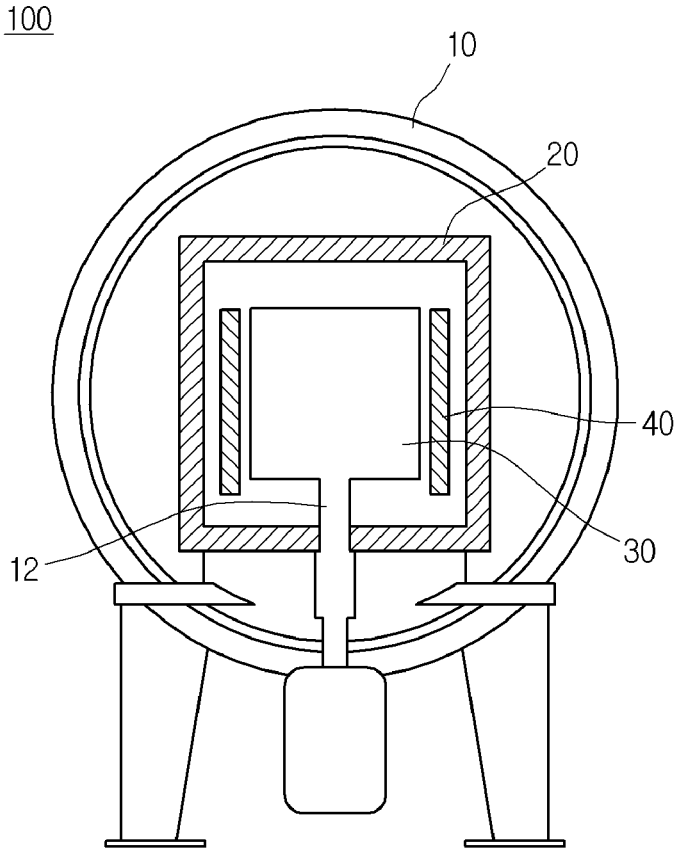

[Fig. 2]
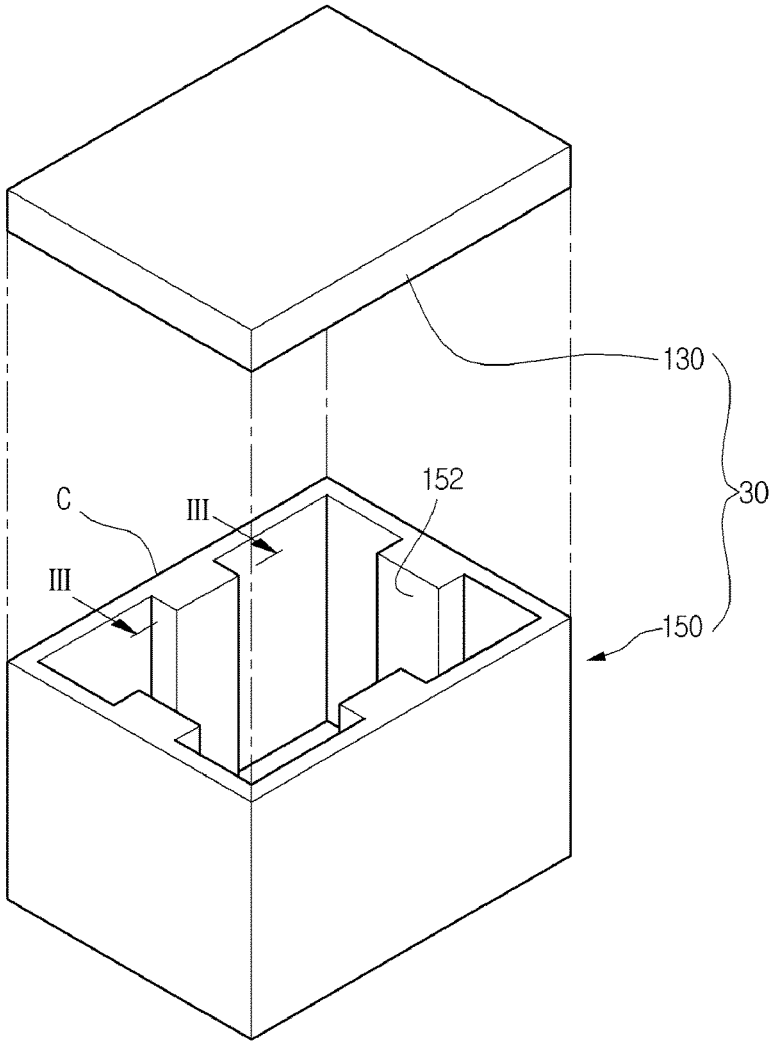
[Fig. 3]
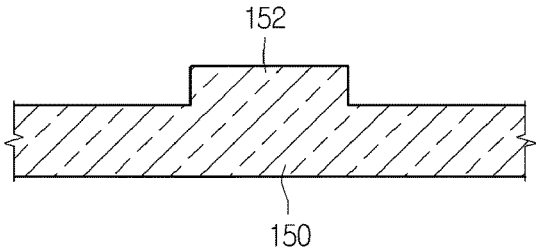
[Fig. 4]
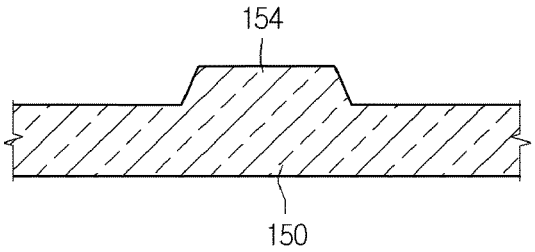

[Fig. 5]
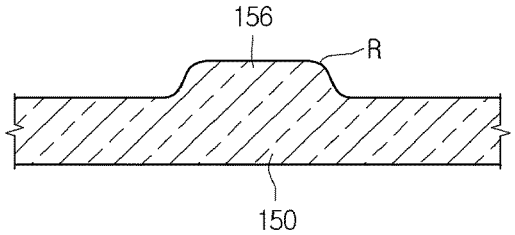
[Fig. 6]
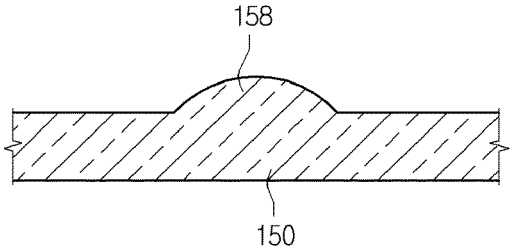
[Fig. 7]
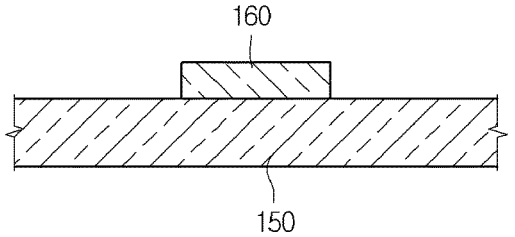
[Fig. 8]
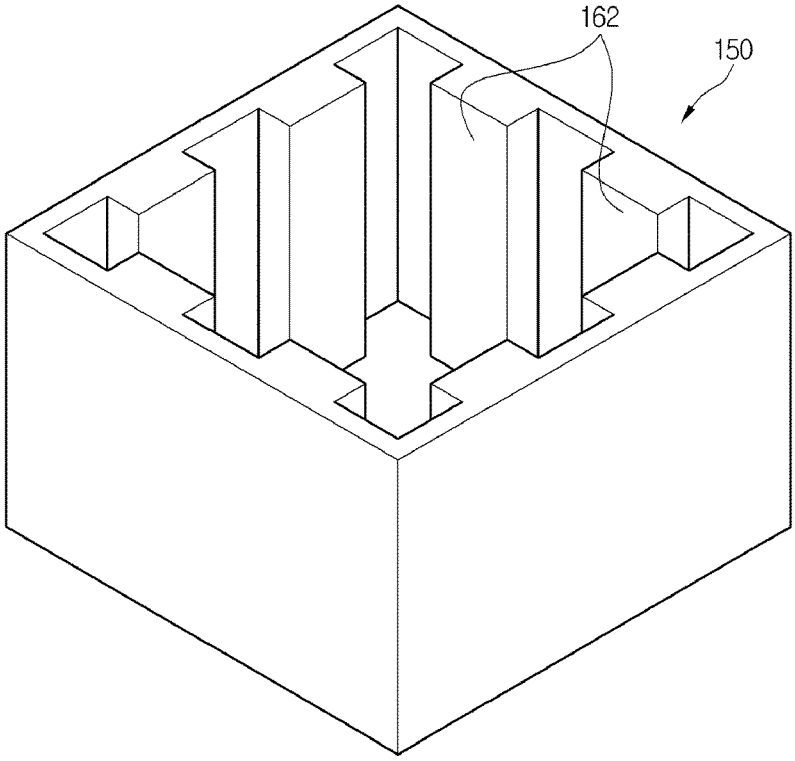

[Fig. 9]
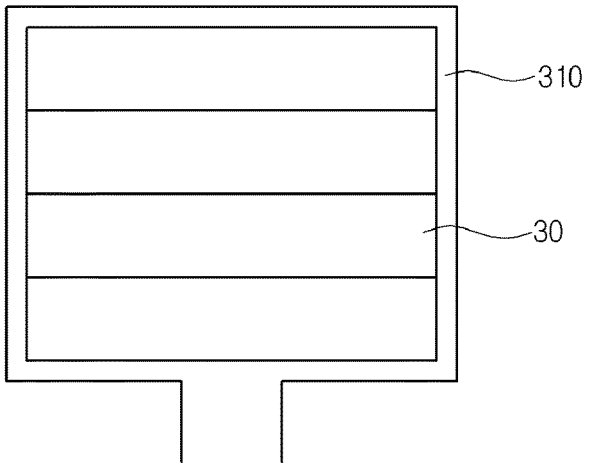
[Fig. 10]
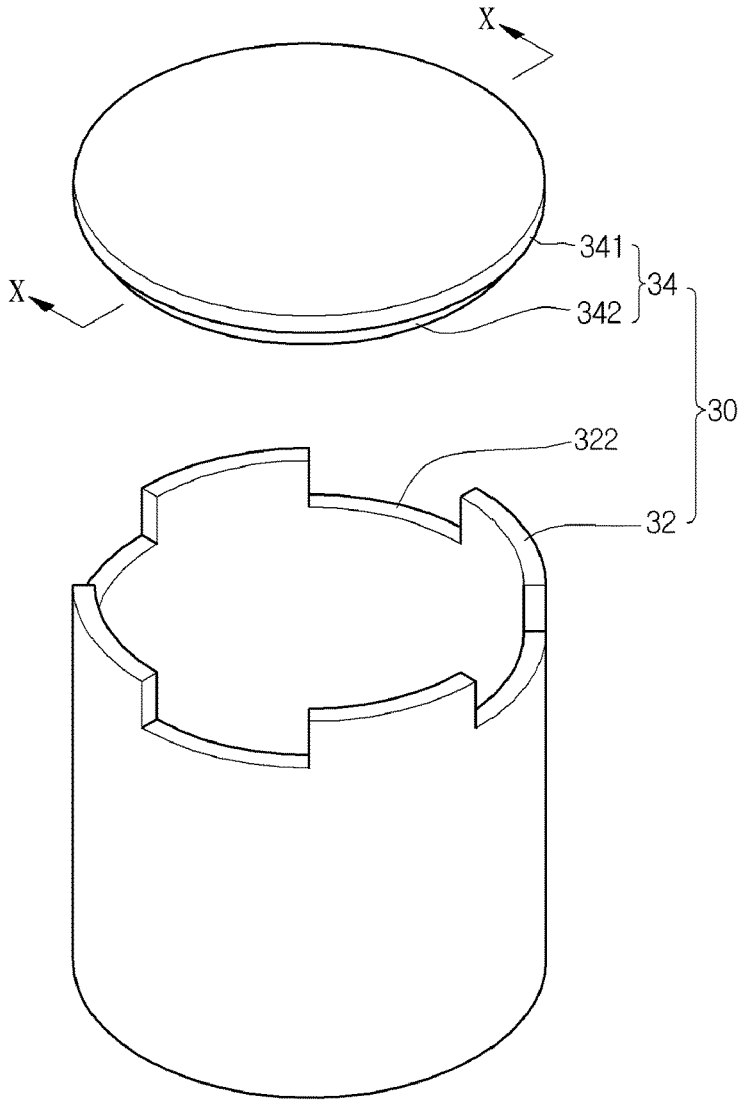

[Fig. 11]
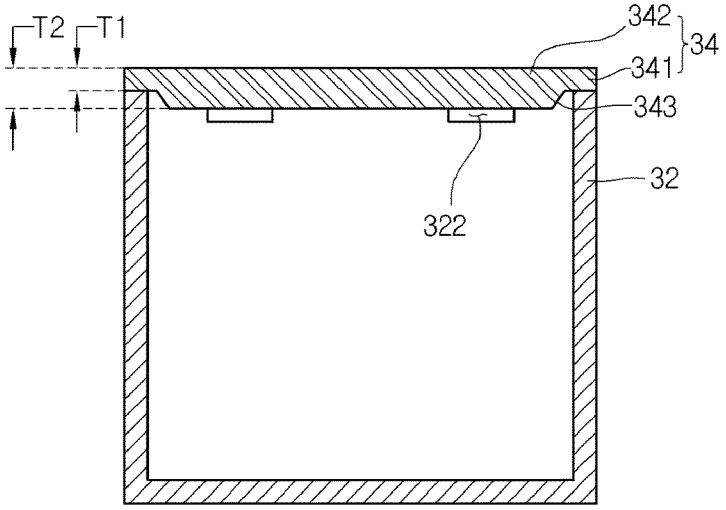
[Fig. 12]
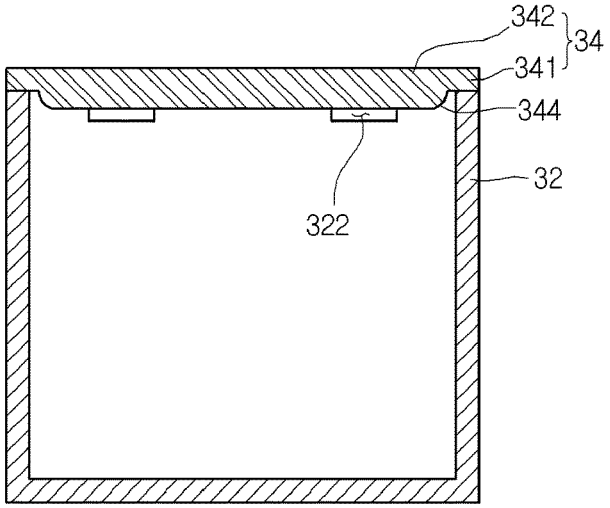
[Fig. 13]
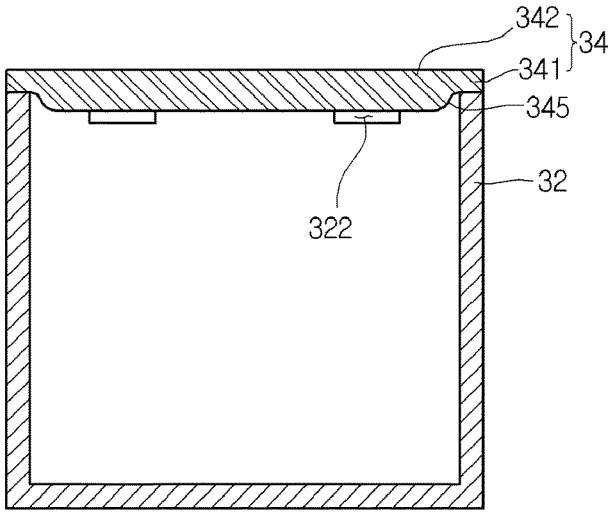

HEAT TREATMENT CONTAINER FOR VACUUM HEAT TREATMENT APPARATUS

CROSS-REFERENCE TO RELATED APPLICATIONS

This application is the U.S. national stage application of International Patent Application No. PCT/KR2011/000682, filed Feb. 1, 2011, which claims priority to Korean Application Nos. 10-2010-0074423, filed Jul. 30, 2010 and 10-2010-0108913, filed Nov. 3, 2010, the disclosures of each of which are incorporated herein by reference in their entirety.

TECHNICAL FIELD

The disclosure relates to a heat treatment container for a vacuum heat treatment apparatus.

BACKGROUND ART

A vacuum heat treatment apparatus, as an apparatus of manufacturing a desired material by heat-treating a raw material in a crucible, has an advantage of preventing pollution from the surroundings from generating by performing a heat treatment in a vacuum state. In the vacuum heat treatment apparatus, a insulating member is positioned in a chamber maintained in the vacuum state and a heat is positioned in the insulating member so as to heat the raw material.

However, a material generated by reacting with the crucible and the raw material during the reaction may be attached on an inner wall of the crucible. Since the generated material is different from the crucible, a heat stress is applied to the crucible due to a difference of heat expansion coefficients between different materials. In a serious case, the crucible may be broken by the heat stress during the reaction. Accordingly, a replacement cost of the crucible is extremely generated, such that productivity may be deteriorated.

DISCLOSURE OF INVENTION

Technical Problem

The present invention had been made in an effort to provide a heat treatment container for a vacuum heat treatment apparatus capable of preventing breakage due to a heat stress.

Solution to Problem

An exemplary embodiment of the present invention provides a heat treatment container for a vacuum heat treatment apparatus including: a bottom portion and a sidewall, and a support protruding inward.

The support may elongate in a depth direction of the heat treatment container.

The support may be positioned the sidewall.

The support may be formed at each sidewall by a single or in plural.

The support may have a rectangular or round cross-section.

The support may be integrally formed to the heat treatment container.

The heat treatment container may be for manufacturing of silicon carbide.

Another exemplary embodiment of the present invention provides a heat treatment container for a vacuum heat treatment apparatus including a plan shape having a curve-shaped portion.

The plan shape of the heat treatment container may be curved.

The plan shape of the heat treatment container may be circular or ellipse.

The heat treatment container may have a inner space and an opened one side, and may further include a cover member covering the heat treatment container, wherein the cover member may include a first portion having a first thickness and contacting the heat treatment container and a second portion having a second thickness larger than the first thickness and corresponding to the inner space.

A side of the second portion adjacent to the first portion may be inclined or rounded with respect to a cover surface of the cover member.

An exhaust passage may be formed at an adjacent portion to the cover member in the heat treatment container.

The heat treatment container may be for manufacturing of silicon carbide.

Advantageous Effects of Invention

According to an exemplary embodiment, the vacuum heat treatment apparatus can prevent the heat treatment container form being modified due to the heat stress at a high temperature by forming a support in the heat treatment container. In this case, the support is formed to elongate in a depth direction of the heat treatment container, to thereby making it possible to prevent efficiently the modification of the heat treatment container.

The vacuum heat treatment apparatus can prevent the modification and the breakage of the heat treatment container by optimizing a shape of the heat treatment container to minimize the heat stress applied to the heat treatment container. Further, the vacuum heat treatment apparatus can prevent breakage due to a collision between a container part and a cover member by optimizing a shape of the cover member.

BRIEF DESCRIPTION OF DRAWINGS

FIG. 1 is a schematic diagram of a vacuum heat treatment apparatus according to an exemplary embodiment;

FIG. 2 is a perspective view of a heat treatment container part of a vacuum heat treatment apparatus according to a first exemplary embodiment;

FIG. 3 is a cross-sectional view illustrating a part of the heat treatment container part taken along line III-III of FIG. 2;

FIG. 4 is a cross-sectional view illustrating a part of a heat treatment container part according to a first modified example of the first exemplary embodiment;

FIG. 5 is a cross-sectional view illustrating a part of a heat treatment container part according to a second modified example of the first exemplary embodiment;

FIG. 6 is a cross-sectional view illustrating a part of a heat treatment container part according to a third modified example of the first exemplary embodiment;

FIG. 7 is a cross-sectional view illustrating a part of a heat treatment container part according to a fourth modified example of the first exemplary embodiment;

FIG. 8 is a cross-sectional view illustrating a part of a heat treatment container part according to a fifth modified example of the first exemplary embodiment;

FIG. 9 is a schematic cross-sectional view illustrating a heat treatment container part according to a sixth modified example of the first exemplary embodiment;

FIG. 10 is a perspective view of a heat treatment container part of a vacuum heat treatment apparatus according to a second exemplary embodiment;

FIG. 11 is a cross-sectional view taken along line X-X of FIG. 10;

FIG. 12 is a cross-sectional view illustrating a heat treatment container part according to a first modified example of the second exemplary embodiment; and FIG. 13 is a cross-sectional view illustrating a heat treatment container part according to a second modified example of the second exemplary embodiment.

BEST MODE FOR CARRYING OUT THE INVENTION

In describing embodiments, it will be understood that when layers (films), regions, patterns, or structures are referred to as being "on" or "under" a substrate, layers (films), regions, pads, or patterns, "on" and "under" include "directly" or "indirectly".

In the drawings, since the thicknesses or sizes of layers (films), regions, patterns, or structures may be modified for clear description, their actual sizes are not fully reflected.

Hereinafter, an exemplary embodiment of the present invention will be described in detail with reference to accompanying drawings.

FIG. 1 is a schematic diagram of a vacuum heat treatment apparatus according to an exemplary embodiment.

Referring to FIG. 1, a vacuum heat treatment apparatus 100 according to the exemplary embodiment includes a chamber 10, an insulating member 20 positioned in the chamber 10, a heat treatment container part 30 and a heating member 40 positioned in the insulating member 20. Hereinafter, a detailed description thereof will be as follows.

An atmosphere gas is injected into the chamber 10 through an atmosphere gas supplying pipe (not shown). The atmosphere gas may use an inert gas such as argon (Ar), helium (He), or the like.

The insulating member 20 in the chamber 10 insulates the heat treatment container part 30 so as to maintain at a proper temperature for the reaction. The insulating member 20 may include graphite so as to withstand a high temperature.

The heat treatment container part 30, in which raw materials are filled and a desired material is generated by reacting with the raw materials, is positioned in the insulating member 20. The heat treatment container part 30 may include graphite so as to withstand a high temperature. The gas generated during the reaction or a non-reacted gas may be discharged through an outlet 12 connected to the heat treatment container part 30.

The heating member 40 heating the heat treatment container part 30 is positioned between the insulating member 20 and the heat treatment container part 30. The heating member 40 may supply the heat to the heat treatment container part 30 by various methods. For example, the heating member 40 may generate the heat by apply voltage to graphite.

The heat treatment container part 30 of the vacuum heat treatment apparatus 100 is a crucible which contains the raw material and applies the heat to manufacture the desired material and it will be described below with reference to FIGS. 2 and 3.

The vacuum heat treatment apparatus 100 may be used as, for example, a manufacturing apparatus of silicon carbide in which silicon carbide is manufactured by heating a mixed raw material including a carbon source and a silicon source.

That is, the mixed raw material including the carbon source and the silicon source is contained in the heat treatment container part 30 of the vacuum heat treatment apparatus 100 and heated together by the heating member 40.

In the exemplary embodiment, the silicon source may include various materials capable of supplying silicon. For example, the silicon source may include silica. The silicon source may be a silica power, a silica sol, a silica gel, a quartz powder, or the like. However, the exemplary embodiment is not limited thereto and an organic silicon compound including silicon may be used as the silicon source.

The carbon source may include a solid carbon source or an organic carbon compound.

The solid carbon source may be graphite, carbon black, carbon nano tube (CNT), fullerene ($C_{60}$), or the like.

The organic carbon compound may be penol, franc, xylene, polyimide, polyunrethane, polyvinyl alcohol, polyacrylonitrile, poly vinyl acetate, or the like. In addition, the organic carbon compound may be cellulose, sugar, pitch, tar, or the like.

The silicon source and the carbon source are mixed.

Further, when the organic carbon compound is used as the carbon source, it is required to use approximately two times more carbon source than the solid carbon source. However, it may have a little difference depending on the carbon amount generated in the carbonization process. When the organic carbon compound is used as the carbon source, the carbon source in the mixed material is carbonized by heating the mixed material of the silicon source and the carbon source. The carbonization is preferably maintained at a temperature of 700° C. to 1200° C., more preferably, 900° C. to 1100° C. However, in the case where the carbon source is not the organic carbon compound, the carbonization may be omitted.

Thereafter, when the mixed material of the carbon source and the silicon source is contained and heated in the heat treatment container part 30, the silicon carbide is manufactured by a carbothermal reaction according to the following reaction formula 1 to 3.

$$SiO_2(s)+C(s)\text{->}SiO(g)+CO(g) \quad \text{[Reaction Formula 1]}$$

$$SiO(g)+2C(s)\text{->}SiC(s)+CO(g) \quad \text{[Reaction Formula 2]}$$

$$SiO_2(s)+3C(s)\text{->}SiC(s)+2CO(g) \quad \text{[Reaction Formula 3]}$$

The heating may be performed in the argon (Ar) or vacuum atmosphere. The degree of a vacuum may be more than 0.03 torr to 0.5 torr or less, preferably, more than 0.03 torr to 0.1 torr or less. In the case of the degree of a vacuum of 0.03 torr or less, since a mechanical load is mostly generated in the mass-produced equipment, additional equipment is required, such that maintenance of the equipment is difficult and the cost is increased.

The heating temperature may be 1300° C. to 1900° C., preferably, 1600° C. to 1900° C. Here, the heating time may be about 3 hours, but is not limited thereto.

As such, the vacuum heat treatment apparatus 100 according to the exemplary embodiment may be used for manufacturing silicon carbide, but is not limited thereto. The vacuum heat treatment apparatus 100 may be used for manufacturing various materials in which the heat treatment is required in the synthesis.

Referring to FIGS. 2 and 3, the heat treatment container part of the vacuum heat treatment apparatus according to the first exemplary embodiment will be described in more detail. FIG. 2 is a perspective view of a heat treatment container part of a vacuum heat treatment apparatus according to a first exemplary embodiment and FIG. 3 is a cross-sectional view illustrating a part of the heat treatment container part taken along line III-III of FIG. 2.

Referring to FIGS. 2 and 3, the heat treatment container part 30 has an inner space and may include a heat treatment container 150 having a opened one side, a cover member 130 covering the heat treatment container 150. The heat treatment container part 30 may be made of a material capable of withstanding at a high temperature, for example, graphite.

The heat treatment container 150 includes a bottom and a sidewall which are integrally formed and has a space portion filled by the raw material. In addition, referring to FIG. 2, a support 152 protruding toward the inside is formed at the inner wall of the heat treatment container 150. The support 152 can prevent the heat treatment container 150 from being modified by the heat stress at a high temperature.

The vacuum heat treatment apparatus used as an apparatus of manufacturing silicon carbide will be described as an example. The carbon source and the silicon source are filled in the heat treatment container 150 and then silicon carbide is generated by the reaction at the high temperature. In this case, since the heat treatment container 150 is made of graphite in order to withstand the high temperature, a silicon carbide layer may be formed in the heat treatment container 150 by reacting with graphite of the heat treatment container 150 and the silicon source. Thereafter, since the silicon carbide layer which is a different material is formed in the heat treatment container 150 made of graphite, a middle portion C of the heat treatment container 150 may be curved toward the outside as compared with the peripheral portion.

In the exemplary embodiment, since the support 152 capable of keeping a curved force is formed at the sidewall of the heat treatment container 150, the modification of the heat treatment container 150 can be prevented.

The support 152 is formed in the inner wall of the heat treatment container 150 as shown in the drawing, but the exemplary embodiment is not limited thereto. Accordingly, the support 152 may be formed at the outer wall of the heat treatment container 150.

The support 152 may elongate in a depth direction of the heat treatment container 150. Accordingly, the modification of the heat treatment container 150 can be prevented.

Referring to FIG. 3, the support 152 may have a rectangular cross-section. However, the exemplary embodiment is not limited thereto. That is, as shown in FIG. 4, a support 154 may have a trapezoidal cross-section. In addition, as shown in FIG. 5, an edge portion R of the cross-section of the support 154 may be rounded. As shown in FIG. 6, a support 158 has in a convex shape and may be entirely rounded. The supports 152, 154, 156, and 158 may have various cross-sectional shapes.

Referring back to FIG. 3, since the support 152 is formed integrally with the heat treatment container 150, a bonding characteristic with the heat treatment container 150 is excellent such that it is possible to efficiently prevent the heat treatment container 150 from being curved. However, the exemplary embodiment is not limited thereto. That is, as shown in FIG. 7, a support 160 is separated from the heat treatment container 150 to be attached to the heat treatment container 150.

Referring back to FIG. 2, the support 152 may be separately formed at each sidewall of the heat treatment container 150. The support 152 may be positioned at the middle portion C of the heat treatment container 150. However, the exemplary embodiment is not limited thereto. That is, as shown in FIG. 8, a support 162 may be plurally formed at each sidewall of the heat treatment container 150. At this time, the supports 162 formed plurally at one sidewall may be separated from each other at a predetermined interval.

Further, in a modified example as shown in FIG. 9, a plurality of heat treatment container parts 30 including the heat treatment container 150 and the cover member 130 are stacked and an outer member 310 may surround the outside thereto. The support (not shown) may be also formed at the outer member 310, but it also belongs to the scope of the exemplary embodiment.

Hereinafter, a heat treatment container part according to another exemplary embodiment of the present invention will be described with reference to FIGS. 10 to 13. The same components as the described embodiment are omitted in detail and different components will be described in detail.

FIG. 10 is a perspective view of a heat treatment container part of a vacuum heat treatment apparatus according to a second exemplary embodiment and FIG. 11 is a cross-sectional view taken along line X-X of FIG. 10.

Referring to FIGS. 10 and 11, a plan shape of the heat treatment container part 30 has a curve-shaped portion to prevent the heat treatment container part 30 from being damaged. The vacuum heat treatment apparatus is used, for example, as an apparatus of silicon carbide.

The carbon source and the silicon source are filled in the heat treatment container part 30 and silicon carbide is generated by the reaction at a high temperature. At this time, the heat treatment container part 30 is made of graphite in order to the high temperature in order to withstand the high temperature, a silicon carbide layer may be formed in the heat treatment container part 30 by reacting with graphite of the heat treatment container part 30 and the silicon source. Accordingly, the silicon carbide layer which is different material may be formed in the heat treatment container part 30 made of graphite. Since a heat expansion coefficient of silicon carbide is larger than that of graphite constituting the heat treatment container part 30 in the related art, the middle portion of the heat treatment container part 30 is expanded. However, in the exemplary embodiment, since the plan shape of the heat treatment container part 30 has the curve-shaped portion, a force applied to the heat treatment container part 30 can be minimized by using directivity between the heat stresses applied to the heat treatment container part 30. Accordingly, the modification and the breakage of the heat treatment container can be prevented.

At this time, since the plan shape of the heat treatment container part 30 is curved, the force applied to the heat treatment container part 30 may be close to almost zero. For example, the plan shape of the heat treatment container part 30 may be circular or ellipse.

In the exemplary embodiment, the heat treatment container part 30 has a inner space and may include heat treatment container 32 having an opened one side and a cover member 34 covering the heat treatment container 32.

The heat treatment container 32 includes an inner space filled with the raw material for the reaction. in addition, an exhaust passage 322 is formed in the heat treatment container 32 so that a gas flows between the cover member 34 and the heat treatment container 32. The gases generated in the heat treatment may be discharged through the exhaust passage 322. The exhaust passage 322 may be formed in the heat treatment container of the first exemplary embodiment (reference numeral 150 of FIG. 2).

The cover member 34 may include a first portion 341 formed at the outer area so as to contact the heat treatment container 32 and a second portion 342 formed at the central area so as to correspond to the space of the heat treatment container 32. At this time, a second thickness T2 of the second portion 342 is larger than a first thickness T1 of the first portion 341 such that the heat treatment container 32 and the cover member 34 can be firmly fixed.

A side 343 of the second portion 342 adjacent to the first portion 341 is inclined with respect to a cover surface of the cover member 34. as such, since the side 343 is inclined, the breakage due to the collision of the heat treatment container 32 and the cover member 34 can be efficiently prevented. The side 343 of the second portion 342 may have various shapes and for example, as shown in FIGS. 12 and 13, sides 344 and 345 may include a round portion.

The cover member 34 may be applied to the first exemplary embodiment described above. In addition, in the exemplary embodiment, as shown in FIG. 5, the plurality of the heat treatment container part 34 including the heat treatment container 32 and the cover member 34 are stacked, the outside can be covered by the outer member (hereinafter, reference numeral 310 of FIG. 5). The cover member of the outer member 310 may include the first portion and the second portion and it also belongs to the scope of the present invention.

The features, structures, effects, and the like described in the exemplary embodiments are included in at least one exemplary embodiment and are not particularly limited to only one exemplary embodiment. Furthermore, the features, structures, effects, and the like described in the exemplary embodiments can be applied to other exemplary embodiments through combination and modification by those skilled in the art to which the exemplary embodiments belong. Therefore, it should be appreciated that contents related with the combination and modification are included in the scope of the present invention.

As described above, the preferred embodiments have been described and illustrated in the drawings and the specification. Herein, specific terms have been used, but are just used for the purpose of describing the present invention and are not used for defining the meaning or limiting the scope of the present invention, which is disclosed in the appended claims. Therefore, it will be appreciated to those skilled in the art that various modifications are made and other equivalent embodiments are available. Accordingly, the actual technical protection scope of the present invention must be determined by the spirit of the appended claims.

The invention claimed is:

1. A vacuum heat treatment apparatus comprising a chamber, an insulating member positioned in the chamber, and a heat treatment container and a heating member positioned in the insulating member;

the heating member heating the heat treatment container and being positioned between the insulating member and the heat treatment container;

wherein the heat treatment container of the vacuum heat treatment apparatus comprises a bottom portion, a plurality of sidewalls, and a plurality of supports;

wherein the sidewalls are monolithically formed with the bottom portion;

wherein each support is respectively positioned on each sidewall and extends to the bottom portion;

wherein the bottom portion is flat;

wherein the bottom portion extends to each sidewall;

wherein each support is a protruding part of its respective sidewall;

wherein the supports are monolithically formed with the bottom portion and the sidewalls;

wherein each support protrudes inward from a sidewall of the heat treatment container;

wherein a height of the supports corresponds to a height of the sidewalls;

wherein each support extends from the bottom portion to an upper portion of the respective sidewall;

wherein each support is formed at an inner portion of its respective sidewall;

wherein each support has a rectangular or round cross-section;

wherein the heat treatment container has an inner space and an opened side, and a cover member covering the heat treatment container;

wherein the heat treatment container is configured to manufacture silicon carbide and comprises graphite;

wherein the cover member includes a first portion having a first thickness and contacting the heat treatment container, and a second portion having a second thickness larger than the first thickness and corresponding to the inner space;

wherein a side of the second portion adjacent to the first portion is inclined or rounded with respect to a cover surface of the cover member, wherein the supports are disposed facing each other and at corresponding portions of their respective sidewalls;

wherein each support comprises a plurality of support portions on the respective sidewall, wherein the support portions are separated from each other at a predetermined interval, and wherein the predetermined interval is greater than or equal to a width of each support portion;

wherein the cover member is in direct contact with an upper surface of each sidewall and an upper surface of each support;

wherein a width of the cover member corresponds to a width of a sidewall of the plurality of sidewalls;

wherein each support is formed and positioned at a middle portion of its respective sidewall; and wherein the heating member disposed on an outer side of the heat treatment container is disposed from the bottom portion of the heat treatment container to the cover member.

* * * * *